US005188065A

United States Patent [19]

Lyndhurst et al.

[11] Patent Number: 5,188,065

[45] Date of Patent: Feb. 23, 1993

[54] WATER PUMP

[76] Inventors: Richard Lyndhurst, 2885 Miguel La., Costa Mesa, Calif. 92626; John D. Drake, 24632 Saturna Dr., Mission Viejo, Calif. 92691

[21] Appl. No.: 846,574

[22] Filed: Mar. 5, 1992

[51] Int. Cl.[5] ..... F01P 5/10

[52] U.S. Cl. ..... 123/41.44; 123/41.47

[58] Field of Search ..... 123/41.44, 41.46, 41.47, 123/198 C; 415/206; 416/185, 188

[56] References Cited

U.S. PATENT DOCUMENTS

| | | | |
|---|---|---|---|
| 1,461,711 | 7/1923 | Bull | 123/41.47 |
| 1,524,320 | 1/1925 | Sparks | 123/41.46 |
| 2,506,547 | 5/1950 | Findley | 123/41.46 |
| 2,568,646 | 9/1951 | Little | 123/41.46 |
| 2,740,388 | 4/1956 | Bennorth | 123/41.12 |
| 2,792,820 | 5/1957 | Leach | 123/195 A |
| 2,812,718 | 11/1957 | Stolte | 415/225 |
| 2,936,745 | 5/1960 | Frank | 123/41.29 |
| 4,385,594 | 5/1983 | Hauser, Jr. | 123/41.29 |
| 4,662,320 | 5/1987 | Moriya | 123/41.44 |
| 4,828,455 | 5/1989 | Kinbara et al. | 123/41.44 |

*Primary Examiner*—Noah P. Kamen

*Attorney, Agent, or Firm*—William W. Haefliger

[57] ABSTRACT

A water pump assembly for use on an internal combustion engine comprising a rotor assembly, including an impeller having a hub affixed to a shaft to be rotated about an axis, and a carrier for the impeller; a body defining a recess and having wall structure defining a frusto-conical taper extending toward an eye, the body defining two outer volute sections opening toward the periphery of the recess, the body also forming a water inlet passage extending in registration with the eye, which defines a water inlet port; the rotor assembly received in the recess so that the hub is centered relative to the eye and projects into proximity to the eye when the carrier is attached to the body, the impeller having blades rotating in proximity to the frusto-conical wall structure; whereby water received in the eye from the inlet passage flows between the rotating hub and the frusto-conical wall structure and between the blades in an outward direction to the volute sections as the impeller rotates.

13 Claims, 5 Drawing Sheets

WATER PUMP

BACKGROUND OF THE INVENTION

This invention relates generally to cooling water pumps, as used on or in connection with internal combustion engines. More particularly, it concerns the construction, assembly and disassembly of such pumps, as well as their integration with engine structure.

There is need for improvements in such water pumps to facilitate ease of disassembly and reassembly. Prior pumps required disassembly of certain engine components to which pumps were attached in order to gain access to pump bearings, seals, rotors, etc., as for parts replacement. Also, there is need for simple, reliable, highly compact and highly efficient pump construction and operation.

SUMMARY OF THE INVENTION

It is a major object of the invention to provide improved water pump structures meeting the above needs. Basically, the pump assembly of the invention comprises:

a) a rotor assembly, including an impeller having a hub affixed to a shaft to be rotated about a axis, and a carrier for the impeller, b) a body defining a recess and having wall means defining a frusto-conical taper extending toward an eye, the body defining two outer volute sections opening toward the periphery of the recess, the body also forming a water inlet passage extending in registration with the eye, which defines a water inlet port, c) the rotor assembly received in the recess so that the hub is centered relative to the eye and projects into proximity to the eye when the carrier is attached to the body, the impeller having blades rotating in proximity to the frusto-conical wall means, d) whereby water received in the eye from the inlet passage flows between the rotating hub and the frusto-conical wall means and between the blades in an outward direction to the volute sections as the impeller rotates.

As will appear, the tapered wall means typically intersects diverging water flow cavities defined by the volute means, and two such cavities are typically provided, wrapping about the tip path of the blades; also, the tapered wall means typically also intersects the water inlet eye.

Another object includes the provision on the carrier of a peripheral locater flange, the body defining a locating surface adjacent which the flange is removably mounted to position the impeller hub in axial registration with the eye, the carrier and rotor assembly being readily removable from the body by detachment of the flange from the body. Bearing means may be located in the removable carrier to mount the impeller shaft for rotation, with a seal located between the bearing and impeller.

Yet another object includes the provision of engine plate structure integral with the body adjacent the inlet passage means, the plate structure attachable to an engine block and forming a cavity to receive timing gearing associated with the engine and proximate the block.

Additional advantages include:

1. Unobstructed inlet to impeller (standard prior pumps have rotating shafts in water inlets).

2. Closer tolerances easily maintained.

3. Dedicated expanding passages for each outlet, giving even water flow to each side of engine.

4. Enables bearing and seal servicing without having to remove complete pump.

5. Flow pattern (entry position) gives pump capability of being integrated with timing gear cover.

6. Different characteristics easily changed (different flow rates, etc.) by mere changing of front assembly, with a different impeller installed.

7. Directional dams and/or deflectors may be placed in inlet passage to increase efficiency.

8. Built-in support for camshaft thrust bearing both in plain pump for use with standard engine front cover and in pump integral with front cover.

These and other objects and advantages of the invention, as well as the details of an illustrative embodiment, will be more fully understood from the following specification and drawings, in which:

DRAWING DESCRIPTION

DETAILED DESCRIPTION

Figure 1:
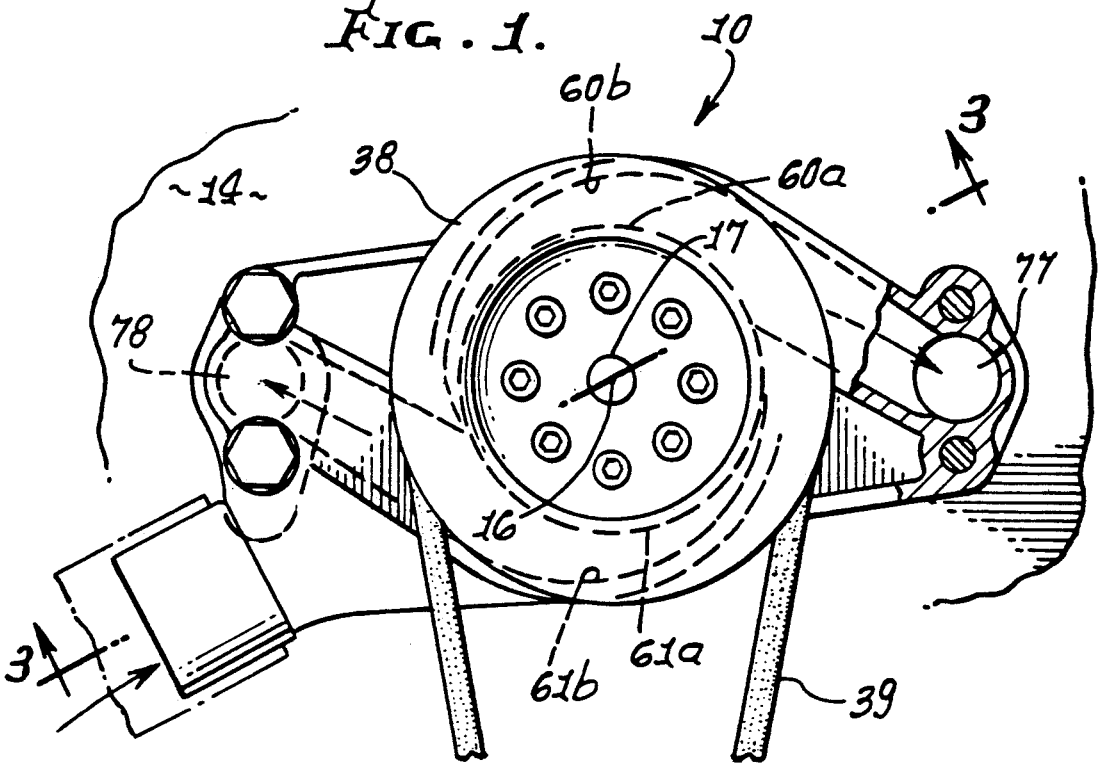
FIG. 1 is an axial end view of pump apparatus embodying the invention.
Figure 2:
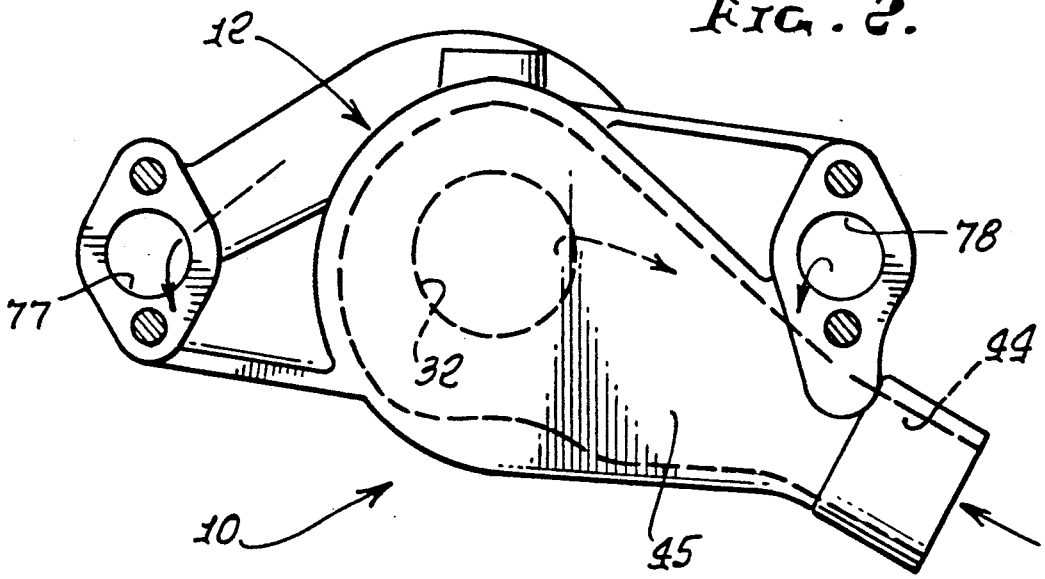
FIG. 2 is an opposite end view of the pump apparatus.
Figure 3:
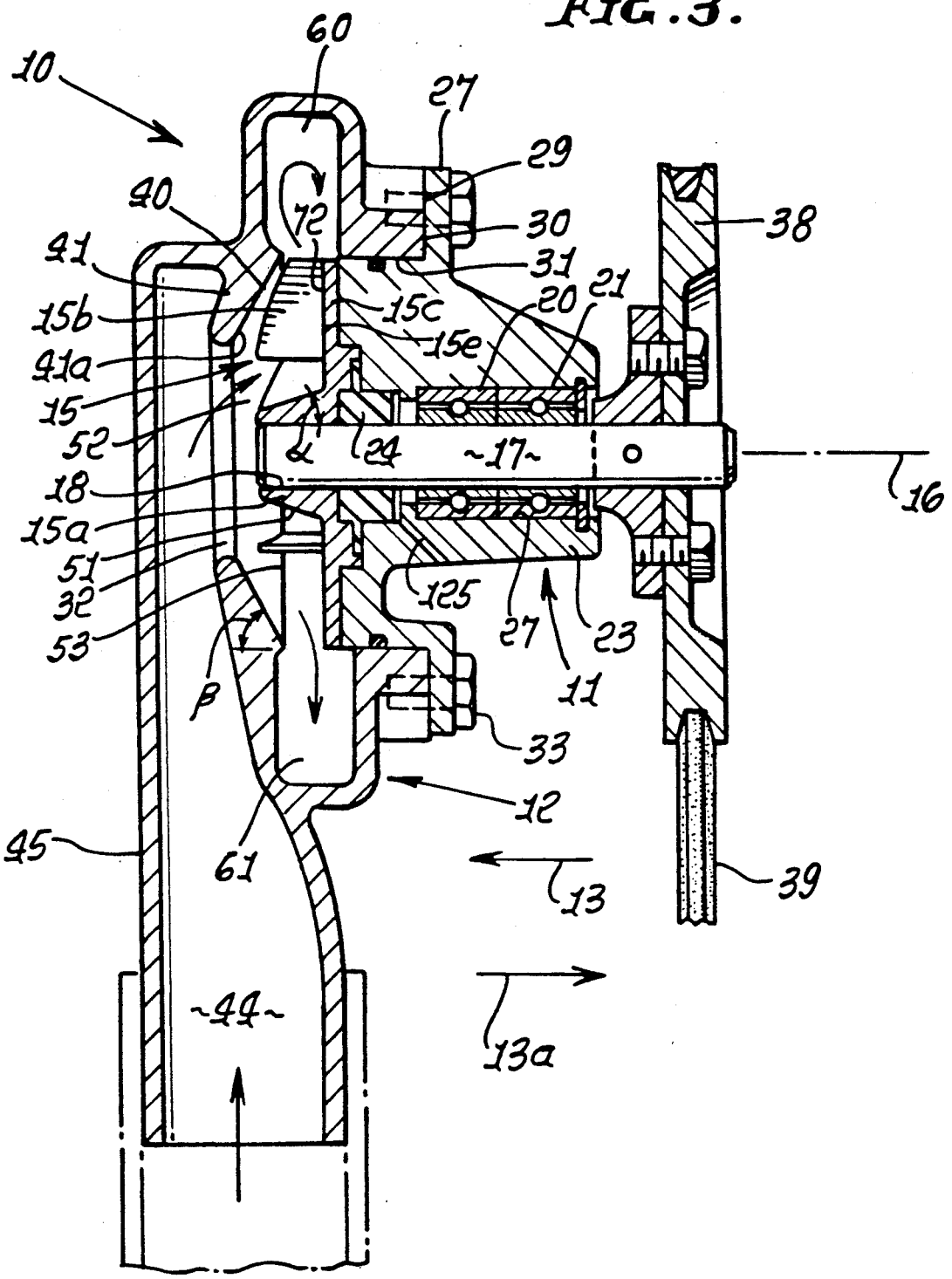
FIG. 3 is an enlarged section taken on lines 3—3 of FIG. 1.
Figure 4:
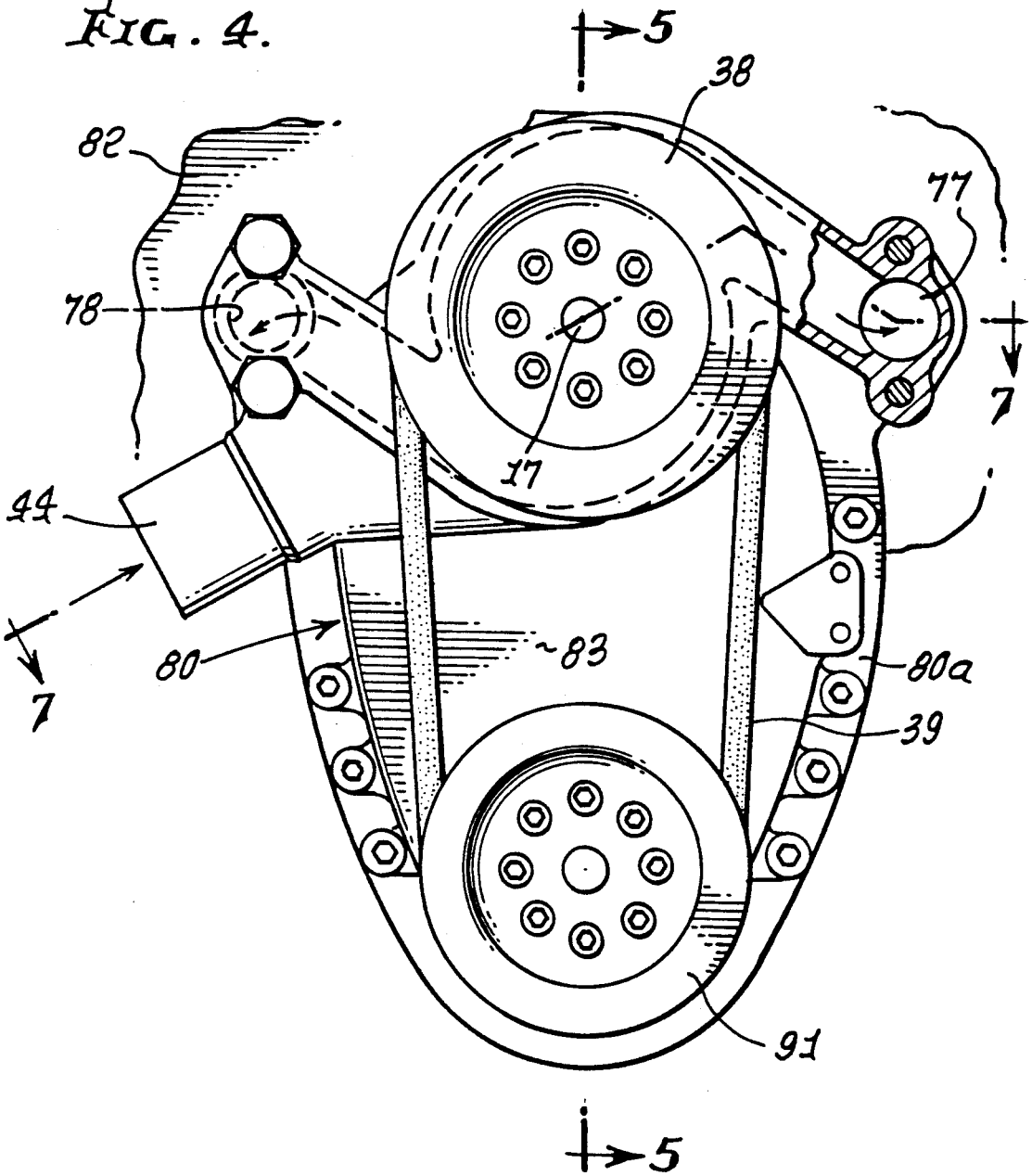
FIG. 4 is a view like FIG. 1 showing pump integration with a timing gear cover.
Figure 5:
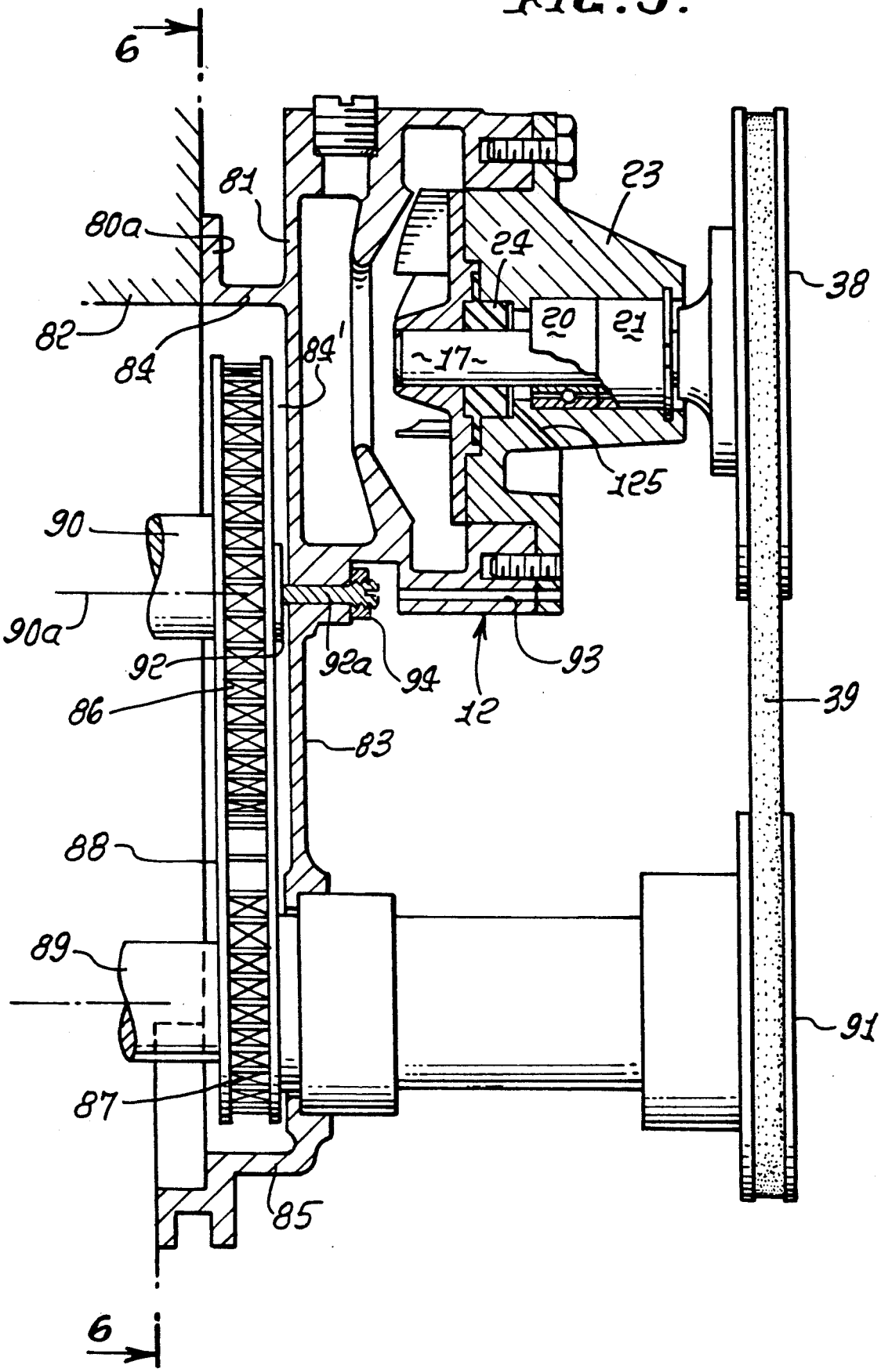
FIG. 5 is a section taken on lines 5—5 of FIG. 4.
Figure 6:
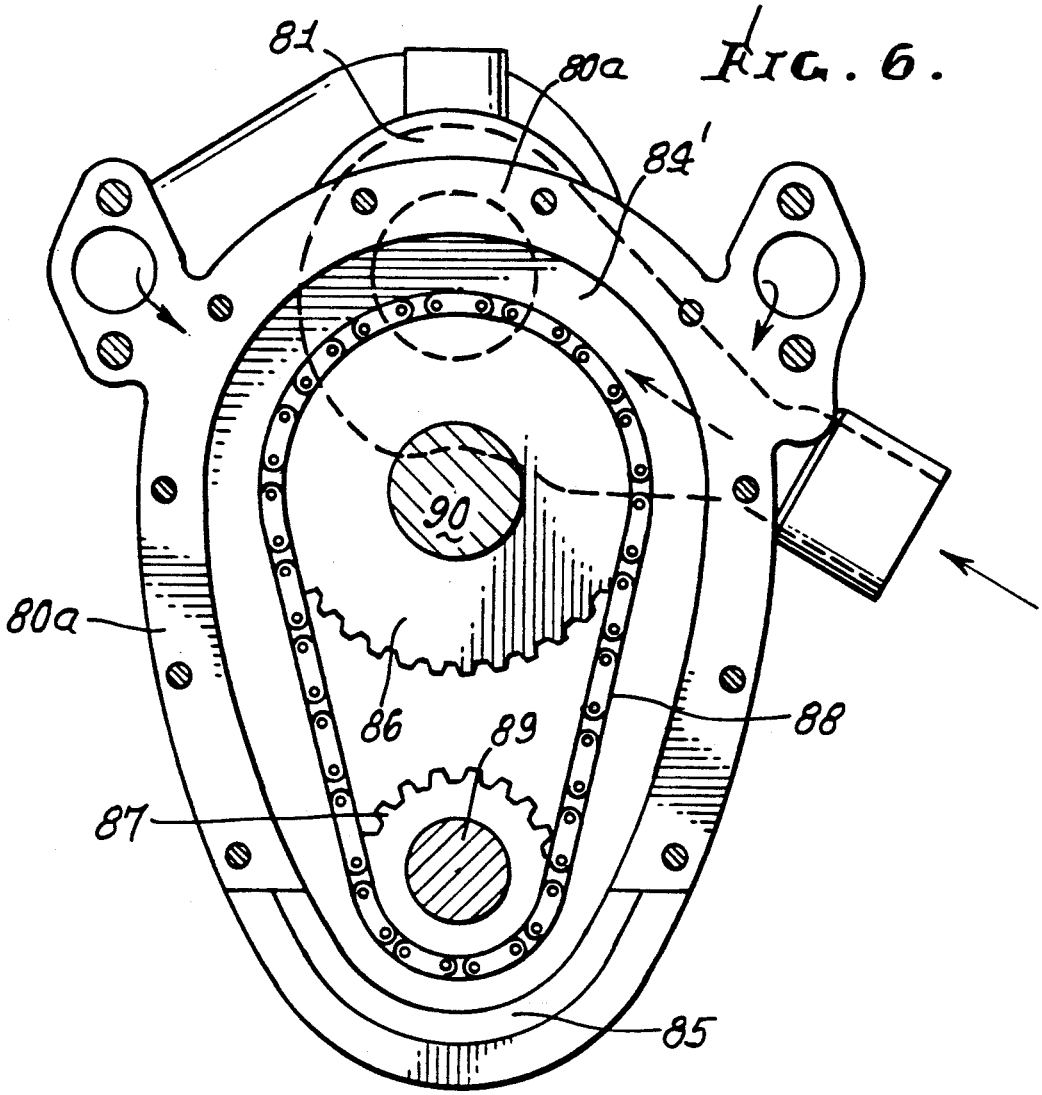
FIG. 6 is a vertical elevation taken on lines 6—6 of FIG. 5.
Figure 7:
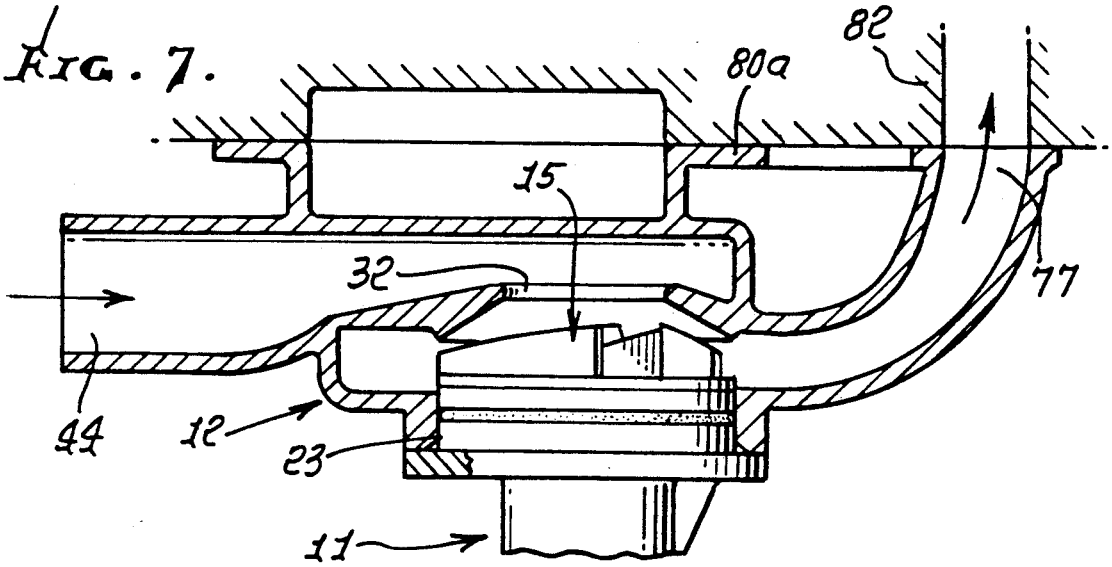
FIG. 7 is a section taken on lines 7—7 of FIG. 4.

In FIGS. 1-3, a water pump assembly 10 includes a rotor assembly 11, and a body or housing 12 to which the rotor assembly is removably attached, and easily attachable, in direction 13, without requiring removal of the body 12 from an engine, indicated at 14. Since the rotor assembly 11 includes the moving parts which may need replacement, such replacement is quickly and easily facilitated as by easy separation of the assembly 11 from the body 12, in direction 13*a*.

The rotor assembly includes an impeller 15 having a hub 15*a* and blades 15*b*, all rotatable about an axis 16 defined by a shaft 17 to which the hub is suitably attached at 18. The rotor assembly also includes a plate 15*c* extending in a plane normal to axis 16, and integral with the blades and hub. Blades 15*c*, splayed out about axis 16, project axially outwardly from the plate, to which the blades are also integrally connected at 15*e*.

The assembly 11 also may typically include a single bearing assembly or bearings 20 and 21 (shown schematically) positioned between the shaft periphery and a bore 27 in a non-rotary carrier 23, mounting the shaft in the carrier, for rotation. In addition, an annular seal 24 is provided about the shaft, whereby the seal is located between the impeller and bearings, preventing water access to the bearings. A weep hole 125 in the carrier 23 extends to a clearance at the seal, to drain leakage to the exterior.

A peripheral flange 27 on the carrier is attachable to a body or housing face 29 normal to axis 16; and the carrier has a cylindrical periphery 30 that closely fits into a bore 31 in the housing to coaxially position the carrier and rotor assembly relative to an eye or water inlet port 32, defined by the housing. Fasteners 33 attach the flange 27 to the housing body, as shown, and are quickly removable to allow rightward separation of the rotor assembly from the housing. A means to rotate the shaft is provided, and may take the form of a pulley 38 on the shaft, and rotatable as by a belt drive 39. Other drive coupling means can be employed.

The body or housing 12 also defines a recess 40 to the left of bore 31, and housing wall means 41 adjacent 40 defines a frusto-conical taper, i.e., wall surface 41*a* converging toward the eye 32. Taper 41*a* is coaxial with axis 16, which centrally intersects the eye. The latter is formed in wall means 41, which projects leftwardly into a water inlet passage 44 defined by duct 45, integral with the housing 12. Duct 45 extends generally radially, relative to axis 16, as shown. Suitable clearances are maintained.

It will be noted that the rotor assembly element 15*a*–15*c* are received in recess 40 so that rotor hub 15*a* is coaxially centered relative to the eye, and projects into proximity to the eye when the carrier is attached to the body, as referred to. Note that the hub has an outer surface 51 that tapers toward the eye, whereby the two frusto-conically tapered surfaces 51 and 41*a* form an outwardly divergent annular passage 52 acting to diffuse the inlet water flow, outwardly into the passage 53 between the rotor blades 15*b* for highly efficient pumping action. The taper of angle $\alpha$ of surface 51 is substantially less than the 45°, whereas the taper angle $\beta$ of surface 41*a* is substantially in excess of 45°, relative to axis 16. These angularities enhance water flow efficiency.

Water flowing in an outward direction between the blades is led into one or the other of two expanding volute sections 60 and 61, better seen in FIG. 1 as wrapping about the paths of blade outer tip rotary travel, at opposite sides (upper and lower) of a horizontal plane through axis 16. See broken lines 60*a* and 60*b*, and 61*a* and 61*b* delineating inner and outer volute surfaces that diverge in the flow directions about axis 16. An efficient diffusing action is thereby achieved. Volute discharge ports appear at 77 and 78, for connection to opposite sides of the engine block.

Tapered or flat wall 72 of rotating plate 15*c* and non-rotary tapered wall 41*a* converge in an outward direction, as shown, whereby the axial dimensions of the blades diminish in an outward direction, as seen in FIG. 3.

In FIGS. 4–7, engine plate structure 80 is made integral with the body or housing 12, as via the water inlet passage 81. See faceplate 80*a* attachable to the engine block 82, and plate 83 offset from plate 80*a* and connected thereto as by walls 84 and 85. Upright plate 83 is joined to or integral with the body 12; and a cavity 84' is formed between plates 80*a* and 83 for reception of engine timing gears 86 and 87 and chain 88. Engine drive shaft 89 drives gear 87, which drives camshaft 90 via chain 88 and gear 86. A pulley 91 on shaft 89 may drive the belt drive 39 for the water pump shaft. These pulleys and the belt may be of toothed construction, as in timing belts. Ease of disconnection of the rotary assembly 11 is clear from FIG. 5.

A camshaft thrust button 92 is located as shown aligned with camshaft axis 9*a*; it is adjustable through access hose 93; and is held in place by locknut 94 on button shaft 92*a*. This feature is provided on both the water pump and water pump with integral front timing cover.

The present pump is constructed to be compatible with General Motors Chevolet "small" block and "big" block, and some V-6 series engines, and to be directly interchangeable with current pumps used on these engines. The invention enables increases in pumping efficiency, and also allows the pump to be integrated with the front timing cover, which previously was not readily achieveable.

I claim:

1. A water pump assembly for use on an internal combustion engine comprising a) a rotor assembly, including an impeller having a hub affixed to a shaft to be rotated about an axis, and a carrier for said impeller, b) a body defining a recess and having wall means defining a frusto-conical taper at an angle $\beta$ extending toward an eye, the body defining two outer volute sections opening toward the periphery of said recess, the body also forming a water inlet passage extending in registration with said eye, which defines a water inlet port, c) the rotor assembly received in said recess so that said hub is centered relative to said eye and projects into proximity to said eye, but is spaced therefrom when said carrier is attached to said body, the impeller having blades rotating in proximity to said frusto-conical wall means, and in outwardly spaced relation to said hub, d) whereby water received in said eye from said inlet passage flows between the rotating hub and said frusto-conical wall means and between said blades in an outward direction to said volute sections as the impeller rotates, e) and wherein said body wall means projects axially and annularly convergently into said inlet passage to form and locate said eye in said passage, the hub having a frusto-conical surface also tapering at an angle $\alpha$ toward said eye and in inwardly spaced relation to the blades whereby the hub tapered surface directs water flow from the eye outwardly to said blades, the body wall means taper substantially exceeding the taper of said hub frusto-conical surface, the hub terminating in axially spaced relation to said eye and to said inlet passage, the angle $\beta$ being substantially in excess of 45° and the angle $\alpha$ being substantially less than 45°, relative to said axis, f) said volute sections defining a plane intersecting said hub and said passage.

2. The pump assembly of claim 1 wherein said tapered wall means intersects diverging water flow cavities defined by said volute means.

3. The pump assembly of claim 2 wherein said tapered wall means also extends to said eye.

4. The pump assembly of claim 1 wherein said carrier includes a peripheral locater flange and said body defines a locating surface adjacent which said flange is removably mounted to position said impeller hub in axial registration with said eye, said carrier and rotor assembly being readily removable from said body by detachment of said flange from said body.

5. The pump assembly of claim 1 wherein said rotor assembly includes a bearing means in said carrier to center and axially mount said shaft for rotation.

6. The pump assembly of claim 5 wherein said rotor assembly includes a seal extending about the shaft and located between the bearing means and the impeller.

7. The pump assembly of claim 6 including a weep hole in the carrier and extending between the seal and the carrier exterior to drain water leaking past the seal.

8. The pump assembly of claim 1 including engine plate structure integral with said body adjacent said inlet passage means, said plate structure attachable to an engine block and forming a cavity to receive timing gearing associated with said engine and proximate the block.

9. The pump assembly of claim 1 wherein said volute sections include ducts extending from entrances proximate the periphery of said recess to exit spaced from said body and at opposite sides thereof.

10. The pump assembly of claim 1 wherein said inlet passage extending directionally generally radially relative to said axis, said volute ducts having entrances spaced apart generally in said direction.

11. The pump assembly of claim 1 including a shaft carrying the rotor assembly remote from the inlet port which thereby remains unobstructed for inlet water flow.

12. A water pump assembly for use on an internal combustion engine comprising a) a rotor assembly, including an impeller having a hub affixed to a shaft to be rotated about an axis, and a carrier for said impeller, b) a body defining a recess and having wall means defining a frusto-conical taper extending toward an eye, the body defining two outer volute sections opening toward the periphery of said recess, the body also forming a water inlet passage extending in registration with said eye, which defines a water inlet port, c) the rotor assembly received in said recess so that said hub is centered relative to said eye and projects into promixity to said eye when said carrier is attached to said body, the impeller having blades rotating in promixity to said frusto-conical wall means, d) whereby water received in said eye from said inlet passage flows between the rotating hub and said frusto-conical wall means and between said blades in an outward direction to said volute sections as the impeller rotates, e) there being engine plate structure integral with said body adjacent said inlet passage means, said plate structure attachable to an engine block and forming a cavity to receive timing gearing associated with said engine and proximate the block, f) and including access hole means in said body to pass a tool for adjusting a camshaft thrust button locating member.

13. The assembly of claim 12 including said member located in said plate structure.

* * * * *